United States Patent [19]

Blackman

[11] 4,078,908

[45] Mar. 14, 1978

[54] DUMP BUCKET FOR A WET-DRY VACUUM SYSTEM HAVING IMPROVED LIQUID FLOW CHARACTERISTICS

[75] Inventor: R. Eugene Blackman, Reno, Nev.

[73] Assignee: Parise & Sons, Inc., Reno, Nev.

[21] Appl. No.: 744,674

[22] Filed: Nov. 24, 1976

[51] Int. Cl.[2] ..... B01D 47/00

[52] U.S. Cl. ..... 55/237; 15/353; 55/447; 55/465; 261/DIG. 54

[58] Field of Search ..... 15/320, 321, 353; 55/255, 256, 462, 465, 238, 257 C, 237, 447; 261/DIG. 54

[56] References Cited

U.S. PATENT DOCUMENTS

| | | | |
|---|---|---|---|
| 963,139 | 7/1910 | Griffiths | 15/353 X |
| 996,991 | 7/1911 | Little | 55/256 |
| 1,363,859 | 12/1920 | Fetters et al. | 15/353 X |
| 1,363,860 | 12/1920 | Fetters et al. | 15/353 X |
| 1,759,947 | 5/1930 | Lee | 15/353 X |
| 2,212,429 | 8/1940 | Yutzler | 55/462 X |
| 2,247,103 | 6/1941 | Summerson | 55/255 |
| 2,673,619 | 3/1954 | Martin | 15/353 X |
| 3,896,521 | 7/1975 | Parise | 15/321 |
| 3,921,250 | 11/1975 | Jerabek | 15/353 |
| 3,980,458 | 9/1976 | Berthoud | 55/255 X |

*Primary Examiner*—Christopher K. Moore

*Attorney, Agent, or Firm*—Sughrue, Rothwell, Mion, Zinn and Macpeak

[57] ABSTRACT

The aspirating liquid flow tube of a dual concentric tube assembly for a vacuum cleaner dump bucket is closed at its upper end, and is provided with opposed radial nozzles for discharging dirty liquid induced by the vacuum promoted air stream tangentially against the curved sidewall of the dump bucket dome above the ring baffle to facilitate separation of the liquid from the air stream and distribute the liquid about the full circumference of the dome sidewall prior to contact with the ring baffle to increase dump bucket capacity without introduction of liquid into the hollow riser tube leading to the vacuum source.

4 Claims, 3 Drawing Figures

DUMP BUCKET FOR A WET-DRY VACUUM SYSTEM HAVING IMPROVED LIQUID FLOW CHARACTERISTICS

BACKGROUND OF THE INVENTION

1. Field of the Invention

This invention relates to application Ser. No. 744,675 entitled "Dump Bucket for a Wet/Dry Vacuum System" filed on Nov. 24, 1976, and assigned to the common assignee.

This invention pertains to vacuum cleaning systems for cleaning rugs, floors, drapes, furniture, etc., but not exclusively, to a hot water extraction system of the type conventionally known as a steam cleaner.

2. Description of the Prior Art

Hot water vacuum extraction systems normally employ a source of hot water which is supplied under pressure in the form of a fine spray against the surface of a rug or floor to be cleaned by means of a nozzle fixed to one side of a vacuum head. The vacuum head contains a narrow slot subjected to vacuum pressure, whereby the hot water and the accumulated dirt from the cleaning action applied to the rug or floor is vacuum removed through the head and passes to a dump bucket subjected to vacuum pressure and connected to the head by way of a flexible pipe and/or wand. The flow of air and accumulated liquid (dirty hot water) is normally discharged through a nozzle within the sealed, dump bucket, whereby the liquid (dirty water) accumulates within the bottom of the dump bucket after separation from the air, which air passes outwardly of the dump bucket through a hollow riser tube which extends upwardly from the bottom of the dump bucket and whose open upper end terminates short of the domed top of the dump bucket.

Dump buckets of this general type are shown, for example, in commonly assigned U.S. Pat. No. 3,911,524 issued Oct. 14, 1975. In order to increase the capacity of the dump bucket which must be periodically dumped as the dirty water accumulates within the container during cleaning of a given surface area of the floor or rug to a degree depending upon the capacity of the container and the size of the cleaner, the dump bucket of the referred to patent incorporates an annular baffle ring or flange which is fixed to the sidewall of the container beneath the domed top and below the point of discharge of the nozzle which returns the dirty water to the dump bucket and sprays it onto the interior surface of that dump bucket such that the air is separated and the dirty water flows down over the annular flange or ring to accumulate within the bottom of the dump bucket. The annular ring has integral strut means extending across the open center of the ring from one side to the other and intersecting the top of the vertical hollow riser tube which projects through an aperture within the strut means. Thus, a portion of the strut means surrounding the riser tube acts as a second baffle for the dirty water accumulating within the dump tank to prevent particularly at the relatively high velocity of air movement through the dump bucket under applied vacuum pressure, the dirty water from splashing into the open end of the hollow riser tube and reaching the source of vacuum pressure, normally constituted by a blower positioned below the dump tank and in fluid communication with the bottom end of the hollow riser tube at the point where it surrounds an aperture within the bottom of the dump bucket.

In copending application Ser. No. 744,675 referred to above, a similar dump bucket to that of U.S. Pat. No. 3,911,524 is employed, except in this case, rather than the nozzle returning dirty water to the interior of the dump bucket and simply spraying dirty water against the interior surface of the dump bucket above the annular ring or flange projecting radially inward from the sidewall of the dump bucket, a pair of concentric, radially spaced vertical tubes are provided. One of the tubes is connected at its upper end to the dirty water return nozzle and in open communication therewith and terminates at a point near the bottom of the container and is open to the lower end of the second of the two concentric, radially spaced tubes. The other tube is closed off at the bottom and open at the top and forms an annular passage extending between the tubes and upwardly towards the top of the dump tank. The second tube comprises an aspirator tube, being apertured near its lower end and open to the interior of the container such that liquid stored or accumulated within the container or dump tank to a level above that aperture is aspirated by the return air and dirty water moving first downwardly within the first tube and then upwardly within the annular passage between the first and second tubes such that the mixture of the return dirty water and the liquid within the container is discharged through the open end of the second tube for impact against the container inner surface to separate the gaseous and liquid components thereof when vacuum pressure is applied to the hollow riser tube such that the return fluid in causing the liquid within the container to enter the stream by aspiration, effects filtering of the return fluid stream.

SUMMARY OF THE INVENTION

The present invention comprises an improvement to the subject matter of application Ser. No. 744,675, and has the upper end of the aspirator tube closed off and employs oppositely directed radial nozzles whose open ends face the annular sidewall of the cylindrical container. Where the concentric radially spaced tubes are eccentrically positioned with respect to the axis of the container, that is, radially offset from the axis of the container, the liquid and air stream impacts the annular sidewall of the container tangentially and sweeps across the major circumferential surface of the sidewall above the annular ring baffle in two flow paths away from the nozzle openings in opposite directions from each other. This slows down the movement of the liquid discharging from the nozzles and utilizes, to the maximum, the baffling function of the ring prior to passing over the ring and accumulating within the bottom of the cylindrical container. The second tube preferably comprises a unitary molded plastic member with the diameter of the nozzles being substantially smaller than the diameter of the vertical portion of the second tube extending between the bottom of the first tube and the return flow pipe. The upper end may be closed off by a dome portion concentrically surrounding an elbow which directs the dirty return liquid to the inner vertical tube of the concentric radially spaced tube assembly.

DETAILED DESCRIPTION OF THE PREFERRED EMBODIMENT

Figure 1:
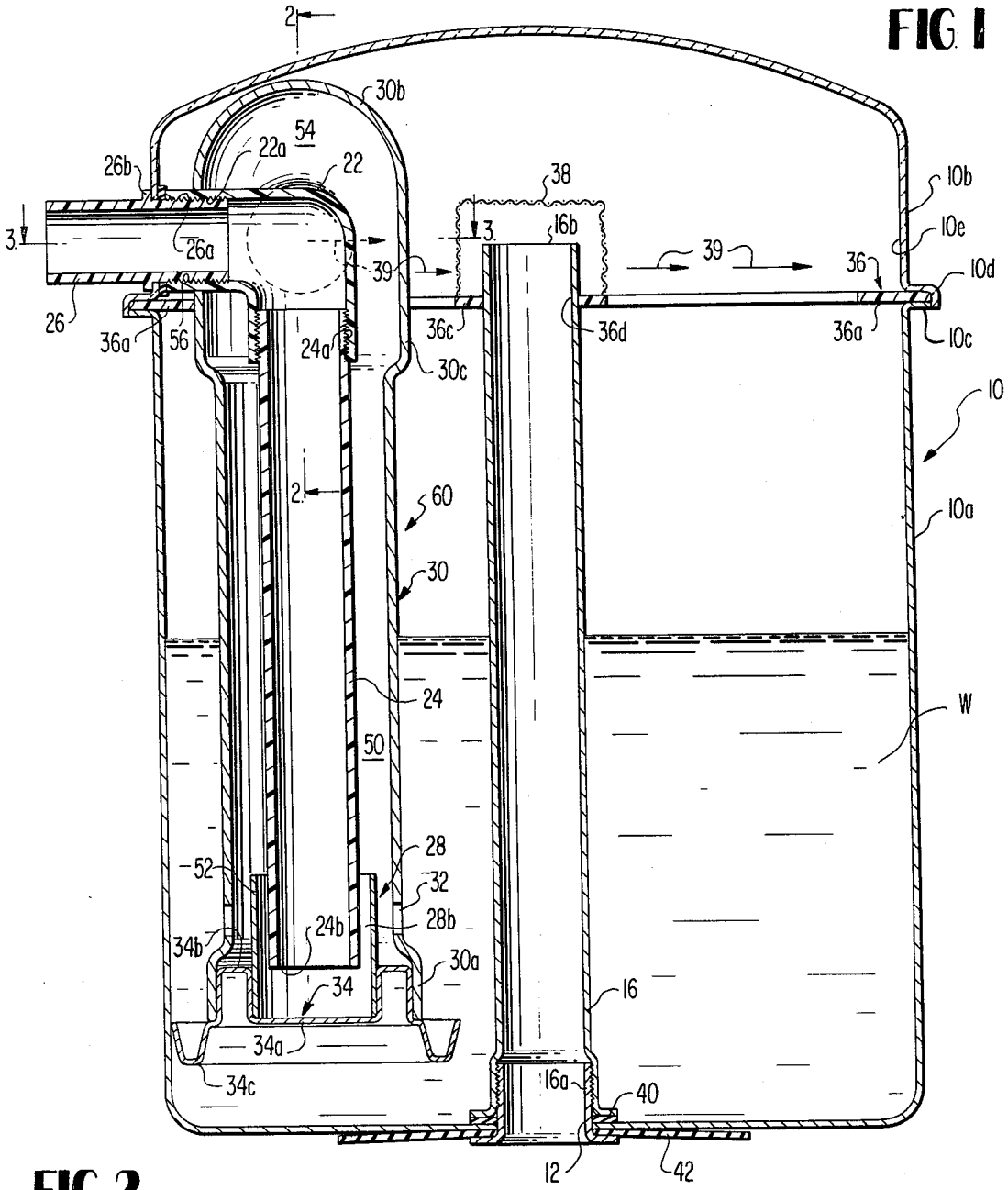
FIG. 1 is a sectional elevational view of one embodiment of the improved dump bucket of the present invention.
Figure 2:
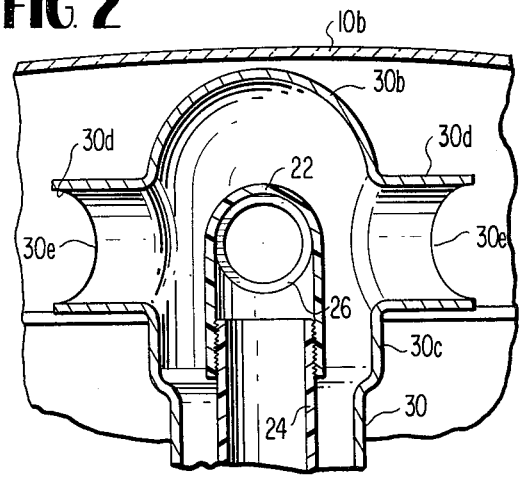
FIG. 2 is a vertical section of a portion of the dump bucket of FIG. 1 taken about line 2—2.

Reference to the drawings shows a dump bucket indicated generally at 10 constituting a cylindrical container formed by a bottom, upwardly open, cup-shaped member 10*a* and a downwardly open, cup-shaped member or dome cover section 10*b*, the bottom member 10*a* terminating in an outwardly directed radial flange 10*c* at its upper end, while the upper member 10*b* terminates at its lower end in a radially outward directed flange 10*d*. In the illustrated embodiment, a unitary, preferably molded plastic, annular ring and strut member indicated generally at 36 has a radially outer annular ring section 36*a* which forms a first liquid baffle of a diameter such that its peripheral edge portion is sandwiched between flanges 10*d* and 10*c* for upper and lower cup-shaped members 10*b* and 10*a*, respectively, and wherein the application of vacuum pressure to the interior of the container 10 maintains a seal between members 10*a* and 10*b* by way of member 36. The container 10 is apertured as at 12 within the bottom cup-shaped member 10*a* and a hollow riser tube 16 is mounted to the bottom of the container 10 by way of a flanged and threaded tube 16*a* which projects through aperture 12 and is threaded to the hollow riser tube 16 with annular seal elements 40 and 42 sandwiched between the container bottom cup-shaped member 10*a* and flanges on members 16 and 16*a* respectively.

Figure 3:
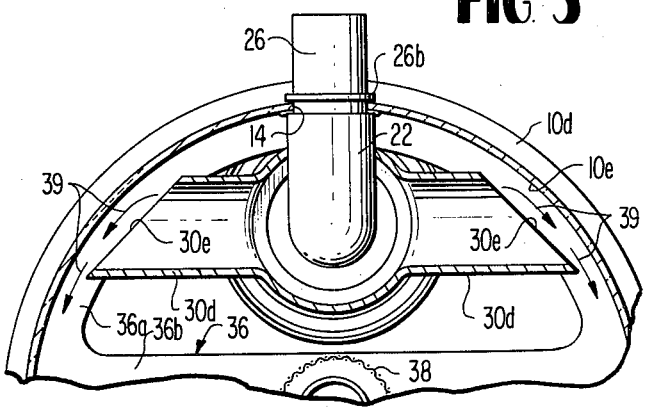
FIG. 3 is a horizontal section of a portion of the dump tank of FIG. 1 taken about line 3—3.

The hollow riser tube 16 terminates at its upper end 16*b*, short of the domed top of the upper cup-shaped member 10*b* but at a point above the level of the unitary ring and strut member 36. In this respect, as seen in FIG. 3, a strut 36*b* extends diametrically across the center of the container 10, being joined at respective ends to the ring section 36*a* of member 36 and intersecting the hollow riser tube 16. The strut is apertured as at 36*d*, the aperture having a diameter on the order of the outside diameter of the hollow riser tube 16 so as to closely receive the upper end of the hollow riser tube and wherein the portion 36*c* of the strut 36*b* surrounding the riser tube 16 acts as a second liquid baffle for the liquid such as the dirty water W which accumulates within the bottom of cup-shaped member 10*a* of the dump tank. An inverted cup-shaped screen 38 overlies the open end 16*b* of the hollow riser tube 16 and is fixed to the strut 36*b* so as to prevent solid material separated in the container 10 from the dirty water or return fluid from passing down through the hollow riser tube 16 to the source of vacuum which is applied to the lower end of the hollow riser tube 16 by way of threaded tube 16*a*. The container is further apertured as at 14 within the annular sidewall of the upper cup-shaped member 10*b* and positioned within this aperture 14 is a dirty water return or inlet tube 26, tube 26 being threaded at 26*a* at its inner end and being provided with a flange 26*b* which is of a larger diameter than the aperture 14 through which the tube projects so as to act as a stop. Further, an elbow 22 formed of plastic material carries threads at 22*a*, and is threaded to the inlet tube 26, such that the end of the elbow 22 forcibly presses an annular seal 44 against the inner surface of the sidewall of the upper cup-shaped member 10*b* to form a sealed connection for the inlet tube 26 to container 10. The other end of the elbow 22 has its inner surface threaded as at 22*c* and a straight fluid return tube 24 carries threads 24*a* at its upper end on its outer periphery and is threaded to the elbow 22 and supported thereby. The elbow 22 and the vertical fluid return tube 24 acts as a continuation of the inlet tube 26 for dirty fluid returning from the vacuum head (not shown) to which it is connected by way of a pick-up hose (not shown).

The fluid return tube terminates at its lower end 24*b* at a level somewhat above the bottom of the lower cup-shaped member 10*a*. A second hollow aspirator tube 30 concentrically surrounds the fluid return tube 24 forming concentric tube assembly 60 and is spaced therefrom being of somewhat larger diameter and defining an annular aspirating flow path 50 therebetween which extends from the bottom 24*b* of the inner of the two tubes to the vicinity of the inlet tube 26. The outer tube 30 terminates at its lower end in an enlarged diameter portion 30*a* to which is mounted a snap on bottom plate indicated generally at 34 of irregular configuration. In this respect, the plate 34 is provided with a central planar portion 34*a*, an inverted U-shape, integral, annular flange portion 34*b*, and terminates in a radial flange portion 34*c* which permits the bottom plate 34 to frictionally snap into the large diameter lower end 30*a* of hollow aspirator tube 30. The snap on bottom plate carries a short length cylinder 52 within annular flange portion 34*b* which forms with the snap on bottom plate 34 an annular cup indicated generally at 28. The cup 28 is of a height such that its upper end 28*a* is at a level above the open lower end 24*a* of the fluid return tube 24 and thereby forms a narrow, annular space or passage 28*b* between these elements such that upon application of suction pressure to the hollow riser tube 16, air and any liquid or solids forming the dirty water, or the fluid return to inlet 26 passes upwardly between the fluid return tube 24 and the cup 28 at high velocity to enter the annular cavity 50 between concentric tubes 24 and 30. Further, the aspirator tube 30 is provided with one or more circumferentially spaced apertures or openings 32 within the side of the same, preferably above the open end 24*a* of the fluid return tube 24 so that any liquid such as the water W which is carried by and/or accumulates within the container 10 above the level of the apertures or openings 32 is aspirated, thereby entering the air and return dirty water stream which moves at high speed from the annular space 28*b* and is redirected vertically upward towards the top of the container.

This portion of the illustrated dump bucket is essentially identical to the dump bucket of the referred to copending patent application and the action of the return fluid entering inlet 26 and its aspirating effect with respect to the water (whether dirty or clear) within the container 10*a* to a level above the apertures or openings 32 of the hollow aspirator tube 30 is identical. However, in the referred to application, the upper end of the aspirator or hollow tube 30 is open so that the aspirated liquid impacts directly against the domed top of the upper cup-shaped member 10*b* for flow down the annular sidewall of that member and over the ring 36*a* of the unitary ring and strut member 36 prior to accumulating within the bottom of the container 10. Further, when clear water is initially applied to the container 10, and the system is employed as a dry vacuum cleaner, dirt suspended in the air stream of the return fluid entering inlet 26 which aspirates the water through openings 32, causes the aspirated water to capture the dust particles within the air stream with the liquid carrying the dust particles impacting against the inner surface of the container above the annular ring 36*a*, whereby the air separates from the liquid and suspended dust particles, and passes through the filter screen 38 to the source of suction by way of the hollow riser tube 16. In fact, the annular passage 28*b* acts as a venturi to create a very high velocity of the return air at this point to facilitate aspiration and mixing of the air with the aspirated liquid such that the air picks up and mixes with and becomes saturated by water drawn into the annular space between the outside of the vertical fluid return tube 24 and the vertical hollow aspirator tube 30.

Contrary to the structure of the referred to application, the upper end of the hollow aspirator tube 30 is closed off by an semi-spherical wall 30*b* whose radius of curvature preferably matches the curvature of elbow 22 so as to form an arcuate space 54 which receives the relatively high velocity air stream and aspirated water W. Further, the upper enlarged diameter end 30*c* of the hollow aspirator tube 30 in the vicinity of the elbow 22 is provided with integral radially projecting discharge tubes or nozzles 30*d*, the tubes 30*d* being cylindrical and terminating at their outer ends in obliquely cut edges 30*e* which face the annular sidewall 10*e* of the upper cup-shaped member 10*b*. Preferably, the enlarged diameter end 30*c* of the hollow aspirator tube 30 is further apertured as at 56 receiving the horizontal portion of elbow 22, with that portion 30*c* of the tube 30 abutting the inner periphery of annular ring portion 36*a* of the ring and strut member 36. This places the complete concentric tube assembly 60 to one side of the container 10 and relatively remote from the center line through which passes the hollow riser tube 16. Incidentally, the hollow riser tube is not necessarily coaxial with the container 10 but may also be positioned eccentrically, that is, closer to one side of this container than the other. However, in the case of the concentric tube assembly 60 formed by tubes 24 and 30, it is preferred that that assembly 60 be positioned within the container close to the inner sidewall of the container with the nozzles 30*d* opening at beveled ends 30*e* adjacent to the sidewall 10*e* of the upper cup-shaped member 10*d* above the annular ring 36*a* such that the liquid portion of the flow stream through annular space 50 in entering the container 10 impacts the sidewall 10*e* of that member of the container generally tangentially thereto and continues to flow generally horizontally along the sidewall indicated by arrows 38 in two directions, away from the elbow 22, maintaining the dirty water in contact with the inner wall surface 10*e* of the upper cup-shaped member 10*b* throughout the major circumferential extent of that wall prior to flowing down and over the ring section or first baffle member 36*a*. This enhances separation of the liquid from the air stream which passes to the vacuum source as indicated by arrows 40 by entering the upper end 16*b* of the hollow riser tube 16. The modified form of the dual concentric tube assembly 60 maximizes the reduction in speed by the frictional contact of the dirty water and entrained dirt particles along the surface 10*e* of the upper cup-shaped member 10*b*, permits the annular ring 36*a* to act as a baffle for this moving water to reduce its speed and retard turbulence prior to falling by gravity over this member and accumulating within the bottom of the container 10. This action permits a maximum volume of water to be accumulated within the container 10 when the dump tank is employed in a hot water extraction system, or permits a large volume of water to be employed as a filter medium when the dump tank is employed in conjunction with a dry vacuum system, without leakage to the vacuum source. The structure may be changed from the illustrated embodiment in the manner described in the copending application without departing from the spirit and scope of the invention. Further, the upper end 30*b* of the hollow aspirator tube 30 may terminate in a flat portion rather than the dome end wall, although the dome end wall 30*b* facilitates the deflection of the return fluid and aspirated water into the laterally opposed nozzles or discharge tubes 30*d*.

While the invention has been particularly shown and described with reference to a preferred embodiment thereof, it will be understood by those skilled in the art that various changes in form and details may be made therein without departing from the spirit and scope of the invention.

What is claimed is:

1. In a dump bucket for a vacuum cleaner system, said dump bucket including:

a cylindrical container having a bottom wall and a top wall;

a hollow riser tube extending upwardly from the bottom wall of said container and open at its bottom to the container exterior and terminating short of the container top wall;

concentric, radially spaced tubes;

one of said tubes comprising a first, hollow fluid return tube having a portion projecting through a wall of the container near its top and having another portion extending vertically downwardly and terminating at a point near the bottom wall of the container, being closed off at its bottom end, and having at least one aperture at its bottom end thereof opening to the other of said concentric tubes;

said other tube comprising a second, hollow tube being closed off at its bottom so as to reverse the direction of flow and to cause return fluid to flow upwardly within said second tube and being open at its upper end and forming with respect to said first tube an annular passage extending upwardly towards the top of the container;

means including said tubes for defining a high velocity flow path within said annular passages;

at least one second tube aperture within said second tube near its bottom and opening to the interior of the container and to said high velocity flow path such that liquid within said container at the level of said at least one aperture within said second tube is aspirated by return fluid moving at high velocity within said annular passage;

the improvement wherein: said second tube is closed off axially at its upper end and carries oppositely directed, radial nozzles opening to the interior of said second tube and being adjacent thereto and having ends opening to the annular sidewall of the cylindrical container such that a mixture of return fluid and liquid within the container is discharged through the open ends of said radial tubes to flow circumferentially in multiple horizontal paths about the circumferential interior surface of said container to reduce the velocity of the liquid and to suppress turbulence thereof when vacuum pressure is applied to the hollow riser tube at the bottom of said dump bucket and wherein said liquid within said container in entering the stream of return fluid effects filtering of the return fluid stream.

2. The dump bucket as claimed in claim 1, wherein said dump bucket comprises an annular baffle ring mounted to the container sidewall below the discharge area of said radial nozzles, and said concentric radial tubes are eccentrically positioned with respect to the axis of the container, and the open ends of said nozzles are oblique to the nozzle axis; whereby, the liquid and air stream in discharging through said nozzles impacts the annular sidewall of the container tangentially to sweep the liquid across the major circumferential surface of the container sidewall above said annular ring baffle along two flow paths in opposite directions from the nozzle openings toward the side of said container remote from the eccentrically positioned concentric tubes.

3. The dump bucket as claimed in claim 2, wherein said first tube comprises the inner of the concentric radially spaced tubes and the second aspirator tube comprises the outer of said two concentrically spaced tubes, and wherein one portion of said first tube extends through said container and comprises a horizontal tube section, a second portion of said first tube comprises a vertical section, and an elbow joins said sections at right angles, and wherein said horizontal tube section and said vertical tube section are of essentially equal diameter and said second tube is closed off at its upper end by a semi-spherical end wall whose center of curvature essentially matches the center of curvature of said elbow joining said first tube horizontal and vertical sections.

4. The dump bucket as claimed in claim 1, wherein said first tube comprises the inner of the concentric radially spaced tubes and the second aspirator tube comprises the outer of said two concentrically spaced tubes, and wherein one portion of said first tube extends through said container and comprises a horizontal tube section, a second portion of said first tube comprises a vertical section, and an elbow joins said sections at right angles, and wherein said horizontal tube section and said vertical tube section are of essentially equal diameter and said second tube is closed off at its upper end by a semi-spherical end wall whose center of curvature essentially matches the center of curvature of said elbow joining said first tube horizontal and vertical sections.

* * * * *